United States Patent [19]

Summers

[11] 4,008,957

[45] Feb. 22, 1977

[54] REPRODUCTION MACHINE CONTROL

[75] Inventor: James E. Summers, Fairport, N.Y.

[73] Assignee: Xerox Corporation, Stamford, Conn.

[22] Filed: May 27, 1975

[21] Appl. No.: 581,386

[52] U.S. Cl. ..... 355/14; 271/9

[51] Int. Cl.[2] ..... G03G 15/22

[58] Field of Search ..... 355/3 R, 14, 18; 271/9, 271/155, 258, 259, 265

[56] References Cited

UNITED STATES PATENTS

| | | | |
|---|---|---|---|
| 3,820,777 | 6/1974 | Reehil | 271/9 X |
| 3,909,128 | 9/1975 | Sohm | 355/14 X |

*Primary Examiner*—L. T. Hix
*Assistant Examiner*—Kenneth C. Hutchison

[57] ABSTRACT

An electrostatic reproduction machine incorporating plural supply trays for the machine copy substrate material to permit switchover from one tray to the other upon depletion of the first tray. The supply trays are individually adjustable to accommodate substrate material of various size and dimension, and inhibit means are provided to prevent such switchover during a copy run in the event the second tray is loaded with substrate material of a different size than the material in the first tray.

2 Claims, 4 Drawing Figures

REPRODUCTION MACHINE CONTROL

This invention relates to a reproduction machine control apparatus and, more particularly, to control apparatus for regulating switchover from one paper supply tray to another.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic plate is electrostatically charged uniformly over its surface and then exposed to a light pattern of the image being reproduced to selectively dissipate the charge in the areas where light strikes the layer. The undischarged areas of the layer thus form an electrostatic charge pattern in conformity with the configuration of the original light pattern.

The electrostatic latent image may then be developed by contacting it with a finely divided electrostatically attractable material, such as a resinous powder. The powder is held in the image areas by the electrostatic fields on the layer. Where the field is greatest, the greatest amount of material is deposited; and where the field is least, little or no material is deposited. Thus, a viewable powder image is produced in conformity with the light image of the copy being reproduced. The powder is subsequently transferred to a sheet of paper or other support surface and suitably fused to thereby form a permanent print.

As reproduction or copier machines progress, machine convenience and throughput speeds reach higher and higher levels. One aspect of this involves the provision of plural paper supply trays; this on the thought that on exhausting of one tray, a second previously filled tray may be then brought into play. This relieves the first tray, and permits the first tray to be replenished while the second tray is in use. This arrangement is especially significant in high speed reproduction machines where sustained and uninterrupted operation is necessary if high throughput speeds are to be achieved.

A further convenience feature of machines of the type alluded to above rests in the ability of the machine to handle different types of copy sheets, i.e. different size, colors, etc. This is effected by loading different copy sheet types in the machine supply trays and intermixing tray actuation to obtain the copy sheet output desired.

It is therefore a principal object of the present invention to provide a new and improved copier or reproduction machine.

It is a further object of the present invention to provide a reproduction machine having multiple paper supply trays.

It is an object of the present invention to provide, in a copier having multiple supply trays, automatic switchover from one tray to another to permit sustained copying and re-loading of a depleted tray.

It is a further object of the present invention, to provide in a reproduction machine having multiple paper supply trays, control means to inhibit automatic switchover from one tray to another except in cases where the trays are loaded with the same size paper.

This invention relates to an electrostatic type reproduction apparatus, comprising, in combination, a photosensitive member on which electrostatic images of the original being reproduced are formed; means to charge the member in preparation for imaging; exposure means to selectively discharge the member to form thereon an electrostatic latent image corresponding to the original; means to develop the image; transfer means to transfer the developed image to a sheet of copy substrate material, a source of substrate material including plural supply trays, at least one of the supply trays being independently adjustable to accommodate substrate material different from the copy substrate material in the other supply tray; transport means to advance substrate material from any supply tray to the transfer means for transfer of the developed image thereto; control means for operating the apparatus to produce a copy run using substrate material from a first one of the supply trays; and inhibit means to prevent drawing of substrate material from a second one of the supply trays during the copy run when the substrate material in the second supply tray is different from substrate material in the one supply tray.

Other objects and advantages will be apparent from the ensuing description and drawings in which.

Figure 1:
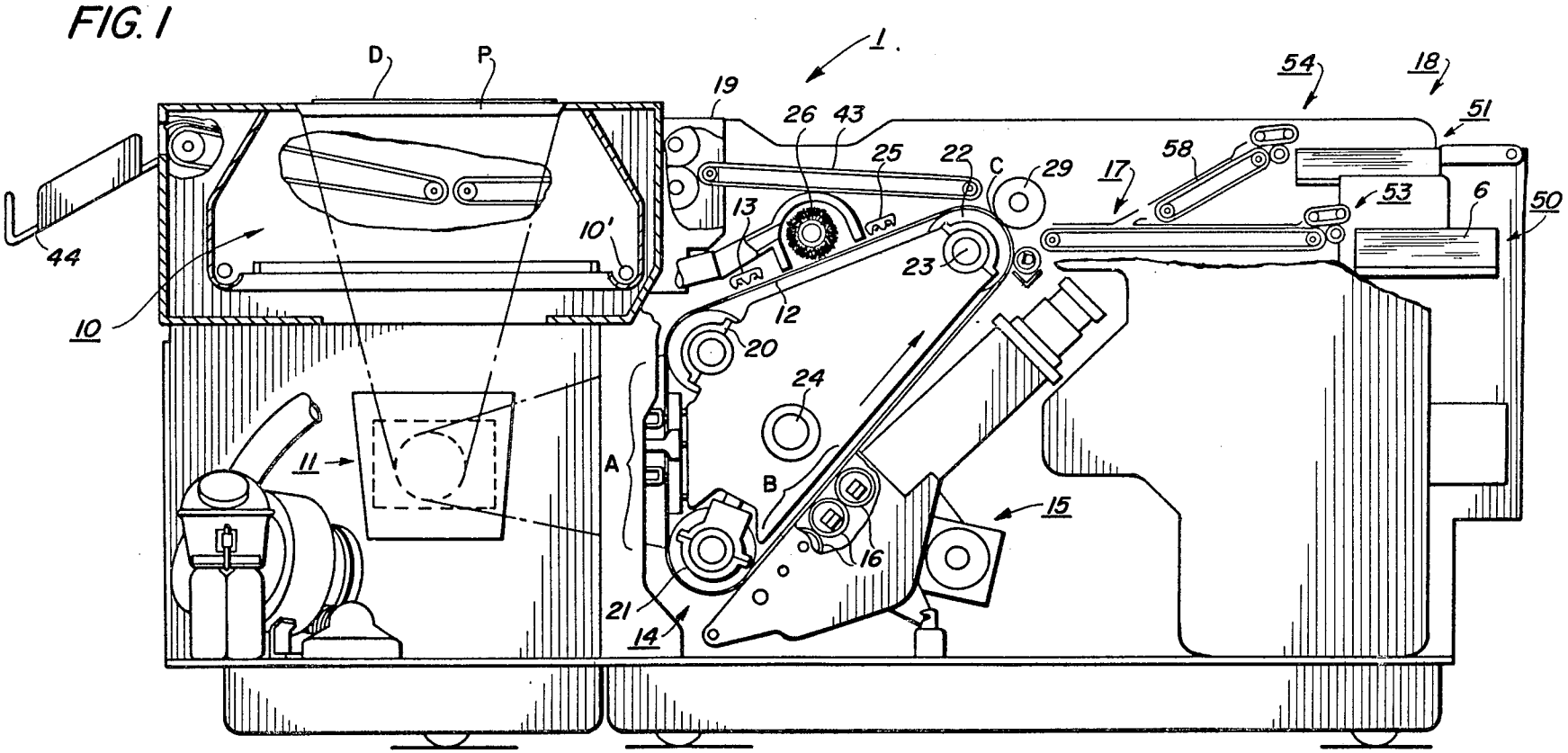
FIG. 1 is a schematic representation of a reproduction machine incorporating the paper tray control arrangement of the present invention.

For a general understanding of the illustrated copier/reproduction machine 1 in which the invention may be incorporated, reference is had to FIG. 1 in which the various system components for the machine are schematically illustrated. As in all electrostatic systems, such as a xerographic machine of the type illustrated, a light image of a document to be reproduced is projected onto the sensitized surface of a xerographic plate to form an electrostatic latent image thereon. Thereafter, the latent image is developed with an oppositely charged developing material to form a xerographic powder image, corresponding to the latent image on the plate surface. The powder image is then electrostically transferred to a support surface and fixed by a fusing device to cause the powder image to adhere permanently to the support surface.

In the illustrated machine, a document D to be copied is placed upon a transparent support platen P fixedly arranged in an illumination assembly, generally indicated by the reference numeral 10, adjacent one end of the machine 1.

While document D is illustrated as being manually positioned on platen P, automatic document handling means such as illustrated in U.S. Pat. No. 3,697,063, issued 10/10/72 may be envisioned.

Light rays from illumination lamps 10' are flashed upon the document D to produce image rays corresponding to the informational areas. The image rays are projected by means of an optical system 11 onto the photosensitive surface of a xerographic plate in the form of a flexible photoconductive belt 12 arranged on a belt assembly, generally indicated by the reference numeral 14.

The belt 12 comprises a photoconductive layer of selenium, which is the light receiving surface and imaging medium for the apparatus, on a conductive backing. The surface of the photoconductive belt is made photosensitive by a previous step of uniformly charging the same by means of a corona generating device or corotron 13.

The belt is journaled for continuous movement upon three rollers 20, 21 and 22 positioned with their axes in parallel. The photoconductive belt assembly 14 is slidably mounted upon two support shafts 23 and 24 with the roller 22 rotatably supported on the shaft 23 which is secured to the frame of the apparatus and is rotatably driven by a suitable motor and drive assembly in the direction of the arrow at a constant rate. During exposure of the belt 12, the portion exposed is that portion A of the belt running between rollers 20 and 21. During such movement of the belt 12, the reflected light image of original document D positioned on the platen P is flashed on the surface of the belt to produce an electrostatic latent image thereon at exposure station A.

As the belt surface continues its movement, the electrostatic image passes through a developing station B in which there is positioned a developer assembly generally indicated by the reference numeral 15, and which provides development of the electrostatic image by means of multiple brushes 16 as the same moves through the development zone.

The developed electrostatic image is transported by the belt to a transfer station C whereat a sheet of copy paper 6 is moved between transfer roller 29 and the belt 12 at a speed in synchronism with the moving belt. A suitable bias is applied to transfer roller 29 to effect transfer of the developed image to the copy paper. A sheet transport mechanism generally indicated at 17 brings sheets of paper 6 forward from a paper supply mechanism generally, indicated by the reference numeral 18 to transfer station C.

Thereafter, the sheet 6, bearing the image is carried by transport 43 into a fuser assembly, generally indicated by the reference numeral 19, wherein the developed and transferred xerographic powder image on the sheet is permanently fixed. After fusing, the finished copy is discharged into tray 44.

Further details regarding the structure of the belt assembly 14 and its relationship with the machine and support therefor may be found in U.S. Pat. No. 3,730,623 issued 5/1/73 and assigned to the assignee of the present invention.

It is recognized that the material upon which the electrostatic reproduction machine 1 may operate may comprise any suitable support such as paper, glass, plastic or the like. It will be assumed, for the purpose of simplifying the present discussion, that the material comprises paper. The supply of paper for the electrostatic reproduction machine is adapted to be stored in an elevator assembly, partially illustrated herein. A more complete description of the operation of a typical elevator assembly and the control means therefore is set forth in U.S. Pat. No. 3,768,806 and assigned to the assignee of the present invention.

Figure 2:
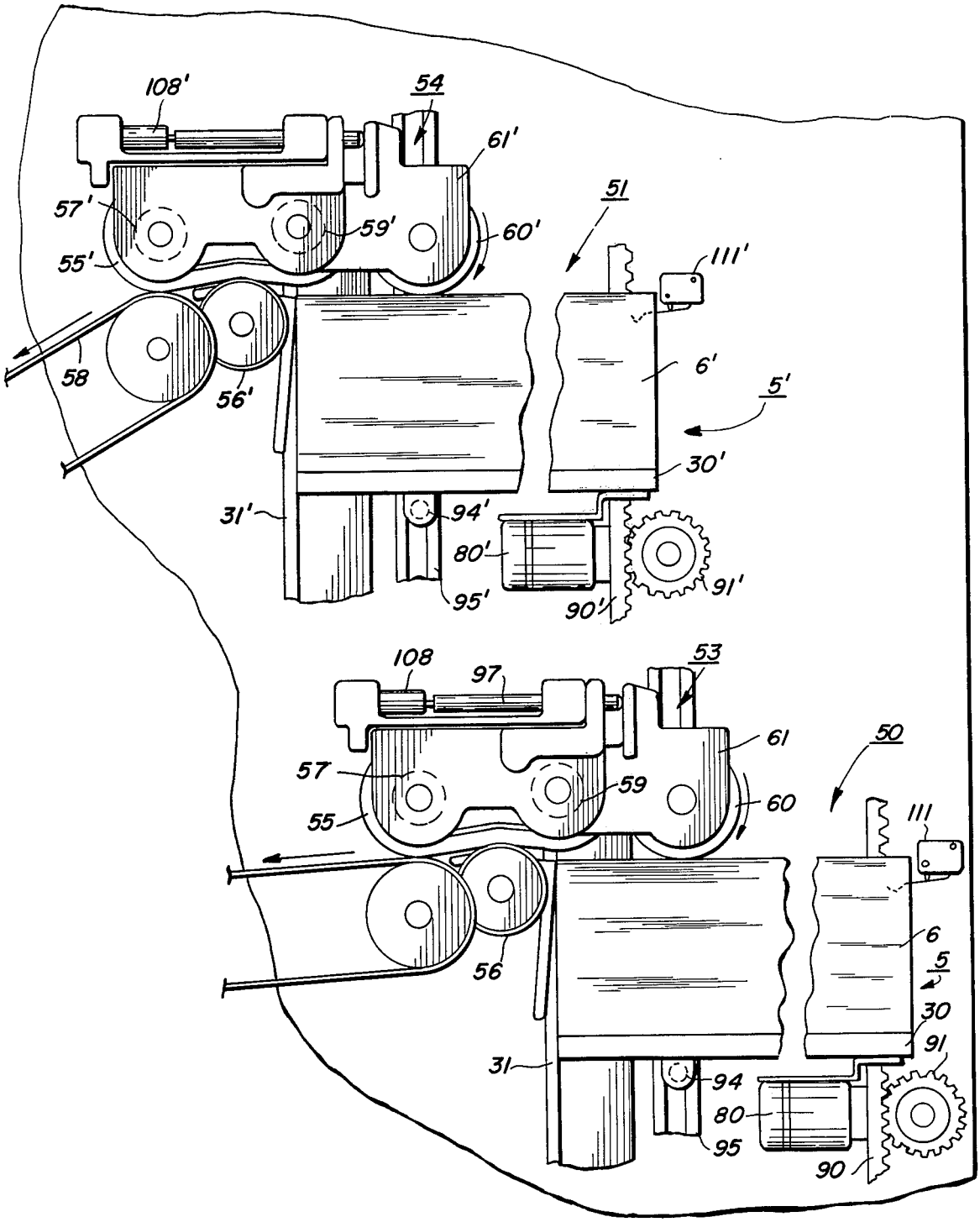
FIG. 2 is an enlarged view in cross section illustrating details of the paper supply trays for the machine show in FIG. 1.
Figure 3:
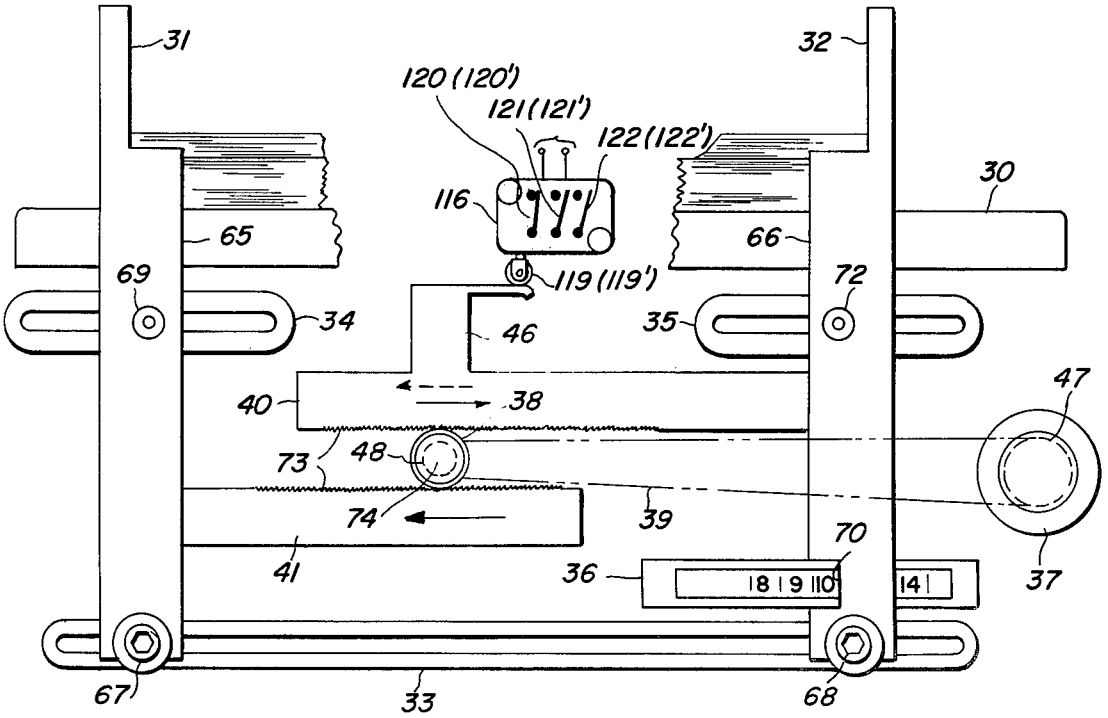
FIG. 3 is an enlarged view in section showing details of the paper size adjusting mechanism for the paper trays shown in FIG. 2.

Referring now particularly to FIGS. 1 – 3 of the drawings, paper supply mechanism 18 comprises a pair of paper trays 50, 51. For convenience, like parts of trays 50, 51 are designated by like numerals in the drawings, those for tray 51 being differentiated by a prime mark. Each tray 50, 51 is adapted to hold a quantity or stack 5 of sheets 6 for use by the reproduction machine 1. For this purpose, the outlet of each tray 50, 51 is operatively connected to transport 17 via individual feeder transports 53, 54 respectively.

As seen best in FIG. 2, each feeder transport 53, 54 comprises feed belt 55 supported by drive and idler rolls 59, 57 respectively. A relatively stationary retard roll 56 engages belt 55 to form a nip between which sheets 6 pass. As will be understood by those skilled in the art, retard roll 56 cooperates with belt 55 to limit feeding to one sheet at a time. An auxiliary transport 58 connects feeder transport 54 of tray 51 with transport 17.

To advance individual sheets 6 from the respective trays 50, 51 each tray is provided with an intermittently driven feed roll 60 supported thereabove for engagement with the topmost sheet in tray 50 or 51. To accommodate slight variation in the height of the paper stack 5, feed roll 60 is supported from swingable frame element 61 pivotally supported for swinging movement about the axis of roll 59. Suitable spring means (not shown) may be provided to bias roll 60 into pressure engagement with the topmost sheet of paper stack 5.

Each paper tray 50, 51 includes platfrom 30 and side guides 31 and 32. Platform 30 provides a support for the sheets 6 stacked thereon, platform 30 being incrementally raised upward during sheet feeding operation to maintain the top-most sheet of stack 5 operative contact with feed roll 60. Sheet guides 31, 32 comprise upstanding generally vertical members, the inside faces 65, 66 of which are substantially planar and are disposed in face to face relationship on either side of platform 30. Guides 31, 32 are preferably arranged adjacent the tray discharge end, the portion of guides 31, 32 below the operating level of sheet stack 5 being generally L-shaped to locate both the side and forward or leading edge of the sheet stack 5. Guides 31, 32 are spaced apart by a distance substantially equal to one dimension of the sheets 6 stacked upon platform 30, i.e. by a distance substantially equal to the sheet length. Guides 31, 32 are of a size sufficient to control the pack 5 of sheets on platform 30, and may extend along the entire side of platform 30 is desired.

Reproduction machine 1 is capable of using sheets 6 of various size i.e. sheet lengths of 11, 13, 14 inches. To accommodate various size sheets, guides 31, 32 are adjustable to vary the effective width therebetween. Each of sheet guides 31, 32 are supported on a suitable support such as slotted member 33, guides 31, 32 being mounted for slidable movement therein by pins 67, 68, respectively. Guides 31, 32 are supported in a proper vertical configuration by slotted upper members 34, 35 respectively. Members 33, 34, 35 are suitably supported on frame portions (not shown) of reproduction machine 1. Pins 69, 72 slidably interconnect sheet guides 31, 32 with upper members 34, 35 respectively. As a result, sheet guides 31, 32 are capable of being laterally adjusted to vary the spacing therebetween. To further support guides 31, 32, a brace (not shown), may be secured between pin 67 and drive plate 41 while a second brace (not shown) may be secured between pin 68 and drive plate 40.

The space between the sheet guides 31, 32 of each paper tray 50, 51 may be manually adjusted by an operator to accommodate various size sheets 6 in trays 50, 51. Guide 32 is preferably provided with an aperture 70 therein for receipt of a stationary indicator 36. Indicator 36 may be calibrated in units of length to provide an indication of the size, i.e. the length of sheet 6 that the tray 50 or 51 associated therewith may accommodate, it being understood that while sheets smaller in size than that indicated may be placed in the tray, the sheet aligning ability of guides 31, 32 comprised.

Drive plate 40 is mechanically coupled to sheet guide 32 by suitable coupling means. Similarly, drive plate 41 is mechanically coupled to guide 31. Drive plates 40 and 41 are arranged to move simultaneously in opposite directions (as shown by the arrows in FIG. 3) to change the spacing between guides 31, 32, respectively while maintaining symmetrical spacing between each guide 31, 32 and the imaginary center line therebetween.

Preferably, each drive plate 40, 41 comprise a rack-like element having teeth 73 along one edge thereof adapted to mesh with toothed pinion 38. It is appreciated that, with drive plates 40, 41 on opposite sides of pinion 38, clockwise rotation of pinion 38 moves drive plates 40, 41 in opposite directions to increase the space between sheet guides 31 and 32. Conversely, counterclockwise rotation of pinion 38 moves plates 40, 41 toward one another to bring guides 31, 32 closer together. Pinion 38 is supported for rotation by suitable stationary journalling means (not shown). For this purpose, pinion 38 may be mounted upon journal shaft 74 which in turn may be conveniently supported upon the frame of reproduction machine 1. While a rack and pinion type driving arrangement is illustrated, pinion 38 may instead comprise a conventional rubber roller adapted for frictional engagement with drive plates 40 and 41.

Rotary motion is imparted to pinion 38 by knob 37 coupled thereto by drive belt 39. Rotation of the knob 37 by an operator works through belt 39 to rotate pinion 38 in the same direction, knob 37 and pinion 38 being provided with suitable pulleys 47, 48 for receipt of drive belt 39. Drive belt 39 may comprise a wire or cable. Instead of pulley and belt drive, suitable sprockets may be provided on knob 37 and pinion 38 with a suitable chain or cog-type belt drivingly connected therebetween. A more detailed description of the elevator assembly partially depicted herein in disclosed in copending U.S. application Ser. No. 270,577 filed on July 20, 1972, now Pat. No. 3,820,777, and assigned to the assignee of the present invention.

A suitable elevator drive, represented schematically by rack and pinion type gear set 90, 91 respectively, is provided to raise and lower platform 30 of trays 50, 51. Reversible tray motors 80, 80', are provided for driving pinion gears 91 and raising and lowering platforms 30 of trays 50, 51 respectively. To effectuate the aforedescribed up and down movement of tray platforms 30 while retaining the platforms in proper alignment, platforms 30 of supply trays 50, 51 are slidably supported as by pins 94 in tracks 95. Tracks 95, which are substantially vertical, are suitably supported on the machine frame.

To sustain operative contact between feed rolls 60 and the topmost sheet 6 in stack 5 of supply trays 50, 51 as the supply of sheets 6 is used up and the stack height reduced, a switch type sensor 108, 108' is provided for each tray 50, 51 respectively. A slidable switch actuating pin 97 operatively connects sensors 108, 108' with the swingable frame element 61 supporting feed roll 60, associated therewith, the arrangement being such that on preset reduction in stack height, the corresponding change in position of feed roll 60 actuates the sensor 108 or 108' associated therewith. As will appear, actuation of sensor 108 or 108' energizes tray motor 80 or 80' respectively in the forward or up direction to raise platform 30. This is turn raises the stack level and on a predetermined increase in stack height, as determined by displacement of feed roll 60, in the opposite direction, the appropriate sensor 108 or 108' is reset to terminate operation of the tray motor 80, 80' associated therewith.

Low paper supply sensors 111, 111' are provided for each supply tray 50, 51. Sensors 111, 111' which are suitably supported adjacent trays 50, 51 respectively, respond to raising of tray platform 30 to a predetermined height reflecting a minimum supply of sheets 6.

To correlate the disposition of sheet guides 31, 32 of each tray 50, 51 with each other as will appear, trays 50, 51 are each provided with a guide position sensor 116, 116' respectively. The operating arm 119, 119' for each sensor 116, 116' respectively is disposed in the path of movement of drive plate 40 of the sheet guide 32 for the tray 50 or 51, the drive plates 40 each being conveniently provided with an extension 46 for this purpose.

Each position sensor 116, 116' preferably consists of a series of switch elements 120, 120', 121, 121', 122, 122' arranged for progressive actuation by the operating arm 119, 119' as the drive plate 40 is moved in one direction or the other to adjust the spacing between sheet guides 31, 32. Accordingly, movement of sheet guides 31, 32 of either paper tray 50, 51 from one paper size to another resets the sensor 116, 116' associated therewith to close a selected one of the switch elements, 120, 121 or 122 of tray 50 or 120', 121' or 122' of tray 51. For example, in FIG. 3, movement of sheet guides 31, 32 outwardly (in the direction of the solid line arrow) to increase the spacing between guides 31, 32 and hence the size sheet 6 that can be accommodated, displaces operating arm 119 to open the previously closed switch element 120 while closing the adjoining switch element 121. Continued outward movement of sheet guides 31, 32 opens switch element 121 while closing switch element 122.

While sensors 116, 116' are illustrated as each having switch elements 120, 120', 121, 121', 122, 122', the number of switch elements may be varied as will be understood.

Figure 4:
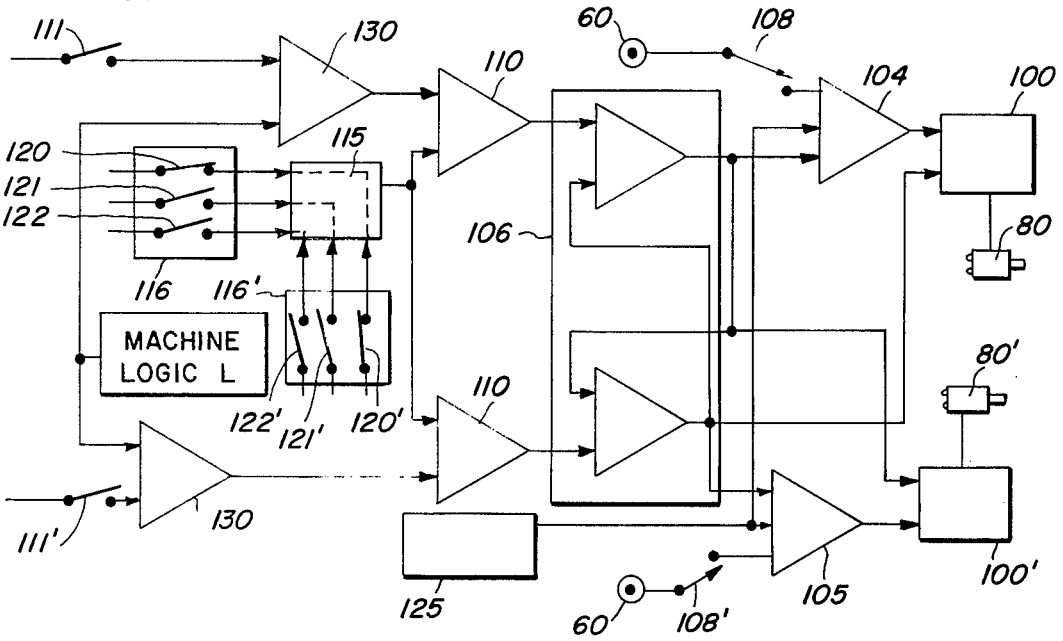
FIG. 4 is a logic schematic of the paper tray control arrangement of the present invention.

The output of the individual switch elements of 116, 116' are fed to a suitable comparison circuit 115 shown in FIG. 4. Circuit 115 serves, when the corresponding switch elements 120, 120', 121, 121', 122, 122' of trays 50, 51 are actuated, reflecting similar sheet size settings, of the tray sheet guides 31, 32, to produce a signal enabling automatic switchover from one tray to the other as will appear While multiple switch type sensors 116, 116' are shown, other sensing arrangements, such as a potentiometer, may be envisioned.

Referring now to FIG. 4 of the drawings suitable motor control suitable circuits 100, 100' for operating tray motors 80, 80' in either a forward or reverse direction to move platforms 30 up or down are provided. Circuits 104, 105 provide an operating signal to motor control circuits 100, 100' respectively to raise the platform 30 for the tray 50, 51 associated therewith.

Circuits 104, 105 are selectively enabled by tray selector flip flop 106. Other enabling signal inputs are provided from stack height sensors 108, 108' and from print control 125 for machine 1. The operating signal to motor control circuits 100, 100' to lower tray platforms 30 is provided by flip flop 106. As will be understood, suitable means (not shown) are provided to prevent over travel of tray platforms 30 in either direction.

The setting of tray selector flip flop 106 is controlled by a pair of circuits 110 responsive to the tray sheet supply as sensed by sensors 111, 111' of trays 50, 51 respectively. Circuits 110 are enabled by signals from comparison circuit 115, which compares the setting of paper guides 31, 32 of trays 50, 51 with one another from the signal inputs supplied by the individual switch elements of guide position sensors 116, 116' respectively. The signal output of comparison circuit 115, enables circuits 110 whenever guides 31, 32 of each tray 50, 51 are set to receive the same size paper.

Circuits 130 provide enabling signals to circuits 110, when the tray sheet supply reaches a predetermined low as sensed by sensors 111, 111' of trays 50, 51 respectively. Main control logic L for machine 1 serves to generate an actuating signal to circuits 130 when the last copy of the copy run in progress at the time the low sheet supply sensor 111 or 111' of the tray 50, 51 in use is actuated.

In operation of reproduction machine 1 and presuming tray 50 to be in use, flip flop 106 is set so that the output signal therefrom enables circuit 104. This in turn places control over motor 80 of tray 50 under stack height sensor 108 during copying as reflected by an enabling signal from print control 125. Thus, as sheets 6 are fed off of the top of the stack 5 in tray 50, the level of stack 5 drops with consequent pivoting movement of the supporting frame element 61 for feed roll 60. Following a preset decrease in stack height, sensor 108 responds, and the output signal therefrom to circuit 104 actuates motor control circuit 100 to energize tray motor 80 and raise platform 30 of tray 50. As the platform 30 moves up, the effective height of the stack 5 thereon, increases. On attaining a preset stack height, sensor 108 is de-actuated. The loss of signal from sensor 108 deenergizes tray motor 80. This action is repeated intermittently in accordance with the usuage of sheets in tray 50 to maintain an uninterrupted supply of sheets 6 for the reproduction machine 1 copying cycles.

Upon platform 30 of tray 50 reaching a predetermined level, reflecting an imminent exhausting of the supply of sheets 6 in the tray 50, supply sensor 111 responds to place an enabling signal on circuit 130. Upon completion of the copy run then in progress, a signal from the machine control logic L triggers circuit 130 to place an actuating signal on circuit 110. If the setting of paper guides 31', 32' of tray 51 correspond to the setting of guides 31, 32 for the tray 50 that was in use indicating sheets in the new tray 51 to be the same size as those in the previously used tray 50, circuit 110 is enabled by comparator circuit 115, and the signal from circuit 130 triggers circuit 110 to reset flip flop 106. The ensuing change in signal output from flip flop 106 resets tray motor control circuit 104 to reverse tray motor 80 and lower tray 50 for refilling. At the same time, motor control circuit 105 is enabled to permit sheets to be fed from tray 51 and operation of machine 1 to continue.

With tray 51, operative, the signal from stack height sensor 108' energizes motor 80' of tray 51 to raise the elevator 30' thereof and bring the topmost sheet of the stack 5' on tray 51 into operative contact with feed roll 60' for tray 51. At this occurrence, tray motor 80' is deenergized with tray 51 ready to provide sheets 6 to reproduction machine 1 on demand.

In the event the signal outputs from sheet guide position sensors 116 to comparison circuit 115 do not match, circuits 110 are not enabled and automatic switchover from tray 50 to tray 51 (or vice versa) is precluded.

While a two tray system has been illustrated, additional trays may be envisioned. And while the control of the present invention is illustrated with two adjustable trays, it will be understood that one tray only may be adjustable with the second fixed to receive one predetermined sheet size.

While the invention has been described with reference to the structure disclosed, it is not confined to the details set forth, but is intended to cover such modifications or changes as may come within the scope of the following claims.

What is claimed is:

1. In an electrostatic type reproduction apparatus having a photosensitive member on which electrostatic images of an original being reproduced are formed, with means to charge the member in preparation for imaging, exposure means to selectively discharge the member to form thereon electrostatic image of the original, means to develop the image, and transfer means to transfer the developed image to a sheet of copy substrate material, the combination of:

a source of said copy substrate material including at least two supply trays, at least one of said supply trays being independently adjustable to accommodate different size copy substrate material;

transport means to advance substrate material from any of said trays to said transfer means for transfer of a developed image thereto;

control means for operating said apparatus to produce a copy run using copy substrate material from a first of said supply trays, said control means including material monitoring means for monitoring the supply of copy substrate material in said first supply tray, said material monitoring means being operative on a preset low supply of copy substrate material in said first tray to switchover to a second one of said supply trays; and inhibit means operative to intervene and prevent switchover from said first supply tray to said second supply tray during said copy run when the size of the substrate material in said second supply tray is different from the size of the substrate material in said first supply tray.

2. The reproduction apparatus according to claim 1 in which said supply trays each include adjusting means settable for different size copy substrate material; said inhibit means including comparator means adapted to compare the size settings of said individual tray adjusting means and to prevent switchover from one tray to another by said control means when said tray size settings are different.

* * * * *